US005921395A

United States Patent [19]

Alexander

[11] Patent Number: 5,921,395

[45] Date of Patent: Jul. 13, 1999

[54] DISPENSER WITH SAFETY LOCKS

[75] Inventor: Linc Winsor Alexander, Langley, Canada

[73] Assignee: Tab-Tote Enterprises Ltd, Vancouver, Canada

[21] Appl. No.: 09/112,860

[22] Filed: Jul. 9, 1998

[51] Int. Cl.[6] ..... B65D 83/04

[52] U.S. Cl. ..... 206/538; 206/1.5

[58] Field of Search ..... 206/528, 538, 206/533, 534, 1.5

[56] References Cited

U.S. PATENT DOCUMENTS

| | | | |
|---|---|---|---|
| 2,828,005 | 3/1958 | Ricke . | |
| 2,975,887 | 3/1961 | Weingart . | |
| 3,393,795 | 7/1968 | Covert, Jr. . | |
| 3,870,192 | 3/1975 | Haley . | |
| 4,083,452 | 4/1978 | Rossmo . | |
| 4,261,468 | 4/1981 | Krebs . | |
| 4,555,044 | 11/1985 | Pearo . | |
| 4,813,173 | 3/1989 | Abbotoy . | |
| 5,322,166 | 6/1994 | Crowther | 206/538 |
| 5,575,392 | 11/1996 | Cutler | 206/538 X |

*Primary Examiner*—Jacob K. Ackun

*Attorney, Agent, or Firm*—Townsend and Townsend and Crew

[57] ABSTRACT

A dispenser for holding articles comprising a generally disc shaped body formed with a plurality of compartments on at least one face of the disc. The compartments are arranged in a generally circular configuration with each compartment being a segment of the circle. There is a cover rotatably mountable to the body to cover the compartments. The cover includes an opening therethrough alignable with each of the compartments by rotation of the cover with respect to the body to permit access to one of the compartments at a time. The dispenser includes an automatic locking system to prevent further movement of the cover with respect to the body each time the cover opening is aligned with a compartment. The lock requires disengagement by a user when the cover opening is to be moved for alignment with another compartment so as to render the dispenser safe from unauthorized use by children.

24 Claims, 6 Drawing Sheets

DISPENSER WITH SAFETY LOCKS

FIELD OF THE INVENTION

This invention relates to a dispenser for organizing and storing articles, and particularly to a dispenser for organizing medication, such as pills or tablets, for timed delivery.

BACKGROUND OF THE INVENTION

Dispensers for storing and organizing articles are well known. In particular, such dispensers are useful for individuals who suffer from medical conditions that regularly require large amounts of pills or tablets, often on a daily basis. It is important that a user be able to store and organize their medication to ensure that all is consumed. Dispensers with individual compartments that represent each day of the week or month can be filled with appropriate numbers and types of pills and tablets once each period. Then, it is simply a matter of opening each compartment on the appropriate day and taking the medication found inside. This arrangement minimizes the time required to organize the medication to a single period each week or month which allows the user to concentrate on collecting and arranging the medication according to their prescription. The dispensers provide a convenient and easy to use central storage location. Most known dispenser are sufficiently small that they are also easily and conveniently transportable by the user.

A problem with existing dispensers is that they often contain large amounts of potentially dangerous drugs that are easily transported. It is not inconceivable that the dispenser could fall into the wrong hands such as those of a child to provide them with easy access to potentially lethal drugs.

SUMMARY OF THE INVENTION

Therefore, there exists a need for a dispenser that includes "child-proof" locking features and yet is still compact, easy and convenient to use.

Accordingly, the present invention provides a dispenser for holding articles comprising:

a generally disc shaped body formed with a plurality of compartments on at least one face of the disc, the compartments being arranged in a generally circular configuration with each compartment being a segment of the circle;

at least one cover rotatably mountable to the body to cover the compartments, the cover including an opening therethrough alignable with each of the compartments by rotation of the cover with respect to the body to permit access to one of the compartments at a time; and an automatically engageable lock to prevent movement of the cover with respect to the body each time the cover opening is aligned with a compartment, the lock requiring disengagement by a user when the cover opening is to be moved for alignment with another compartment.

The dispenser of the present invention also includes a lock to releasably locate the cover to the body.

The locks render the dispenser of the present invention safe from unauthorized use by young children who are unable to manipulate the lock mechanisms. The dispenser is designed such that the locks are incorporated into a compact body that is easy to use and renders the dispenser easy to transport.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Referring to FIGS. 1–3*a,* there is shown a dispenser 2 for holding articles, particularly pills or tablets, according to a first, preferred embodiment of the present invention. In FIGS. 1–3*a,* the dispenser is shown in its assembled state. FIGS. 4–10 show individual components of the dispenser.

Figure 3:
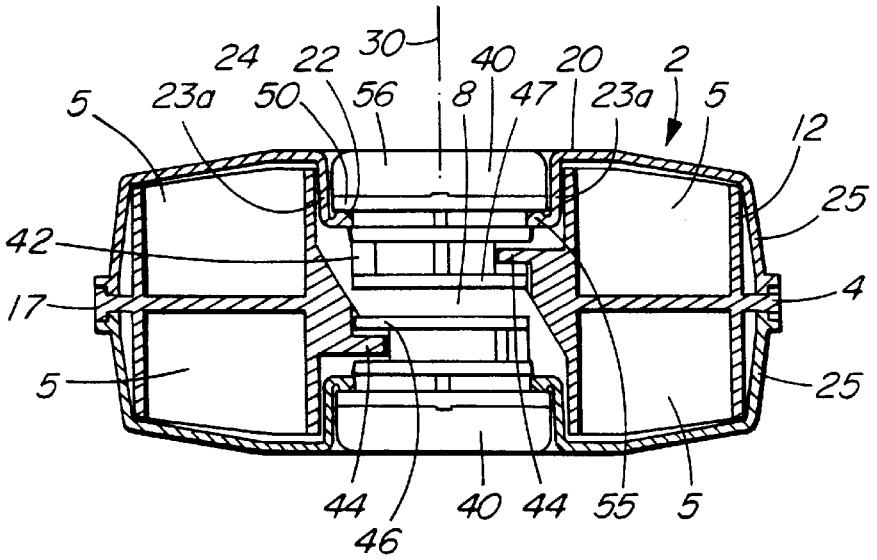
FIG. 3 is a section view taken along line 3—3 of FIG. 1 through the dispenser.
Figure 3A:
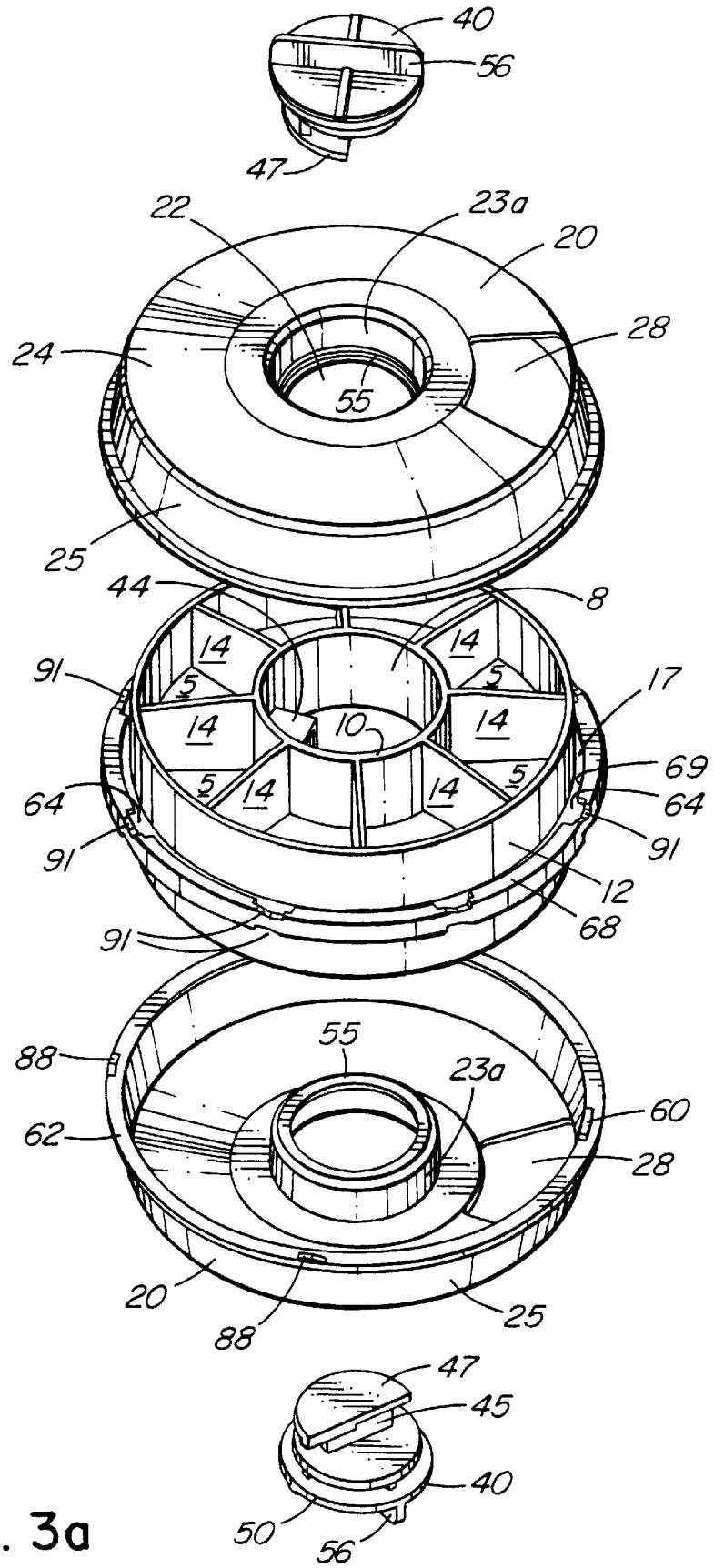
FIG. 3*a* is an exploded view of the dispenser of FIG. 1.

As best shown in FIGS. 3*a,* 9 and 10, the dispenser includes a generally disc shaped body 4 formed with a plurality of compartments 5 on at least one face of the disc. In the illustrated embodiment, compartments 5 are formed on both faces of the body. The compartments are arranged in a generally circular configuration about a central cavity 8 in the body with each compartment being a segment of the circle with an open top. The compartments extend from an inner circular wall 10 defining cavity 8 to an outer circular wall 12. Walls 14 extend radially between inner wall 10 and outer wall 12 to define each compartment. An annular surface 16 extending from inner wall 10 and intersecting outer wall 12 defines the floor of each compartment and also defines an outer flange 17 about body 4.

Figure 11:
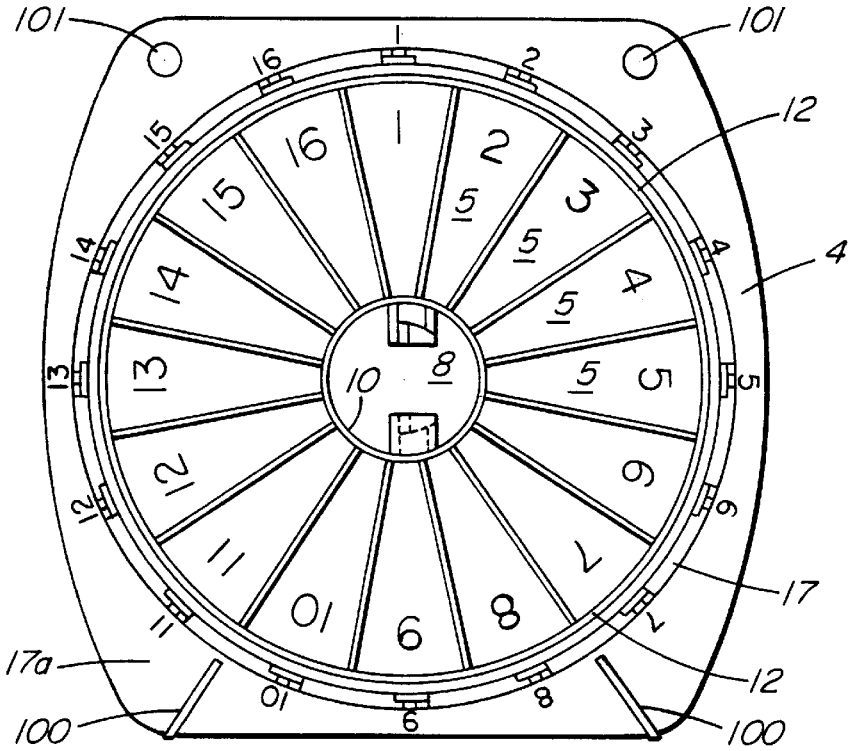
FIG. 11 is a side view of a body used with a second embodiment of the present invention that can be stood on its end.

Preferably, the compartments are marked by indicia. For example, in FIG. 9, the floor of each compartment is marked by an abbreviation 18 for a day of the week and an arrow to indicate the direction to the next compartment to be used. Alternatively, as shown in FIG. 11 illustrating a second embodiment, the compartments 5 can be marked with numbers indicating the days of the month.

Referring to FIGS. 3, 3*a* and 4–6, the open tops of compartments 5 are enclosed by a cover 20 that is rotatably mountable to body 4. Cover 20 is circular and dimensioned to fit over body 4. The cover includes a central opening 22 that is formed in a central circular depression 23 in the cover defined by inner wall 23*a*. A generally flat, disc surface 24 extends from wall 23*a* to an outer downwardly depending wall 25. Preferably, walls 25 are angled outwardly at an angle of approximately 7½ degrees from the vertical as shown by angle 27 in FIG. 6. As best shown in FIG. 3, when assembled on body 4, wall 23*a* and central opening 22 fit within central cavity 8 of body 4. Disc surface 24 extends over the top of compartments 5 and outer cover wall 25 extends downwardly adjacent outer wall 12 of body 12 to contact outer flange 17.

Cover 20 also includes an opening 28 through surface 24 to permit access to one of the compartments 5 at a time. As best shown in FIG. 3, wall 23*a* inserted into central body cavity 8 defines an axis of rotation 30 for cover 20 with respect to body 4. Rotation of cover 20 about axis 30 allows opening 28 to be aligned over compartments 5 to permit access to the contents of the compartment. Preferably, cover 20 is translucent or transparent to allow viewing into the covered compartments.

Referring to FIG. 3, a key 40 is used to removably secure cover 20 to body 4 for rotatable movement about axis 30. Key 40 comprises a post 42 that is insertable into cavity 8 of body 4. Cavity 8 includes an inwardly extending surface 44 formed integrally with inner wall 10 of body 4. To permit insertion of post 42 past surface 44, post 42 is sectioned along flat surface 45 as shown in FIGS. 3*a* to define a generally semi-cylindrical post.

Figure 9:
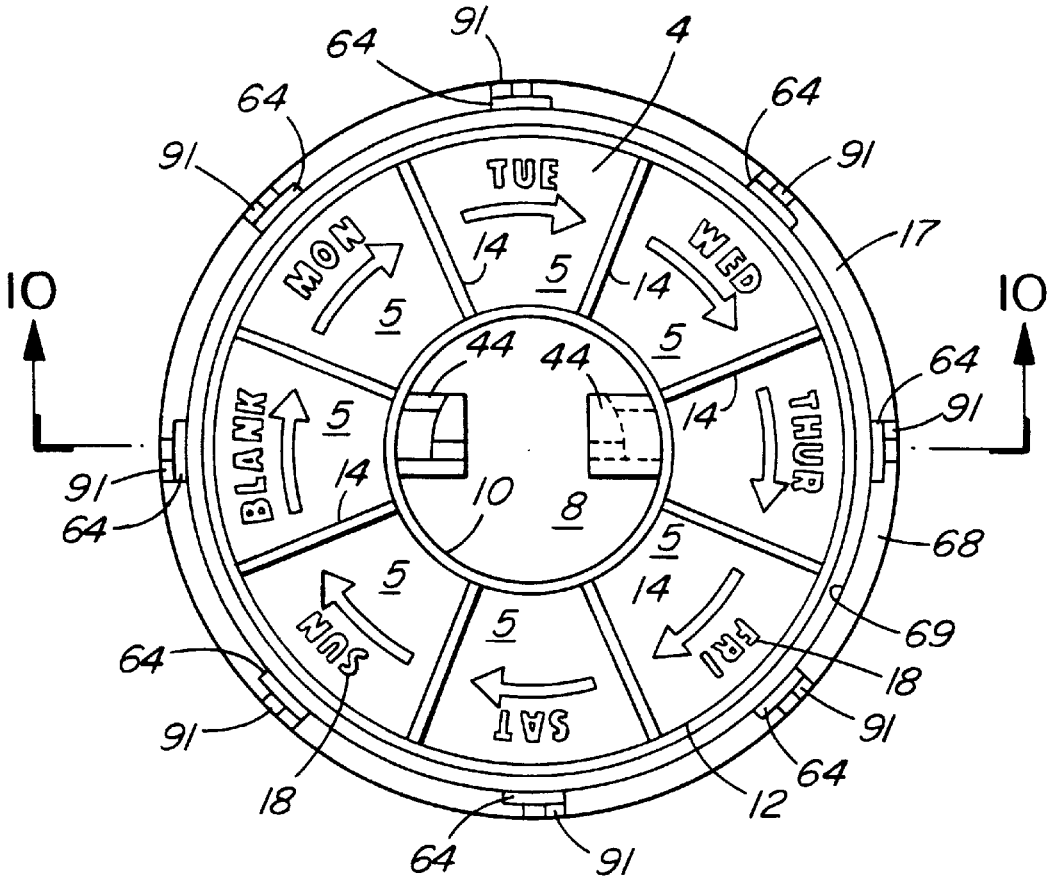
FIG. 9 is a top view of the body of the dispenser.
Figure 10:
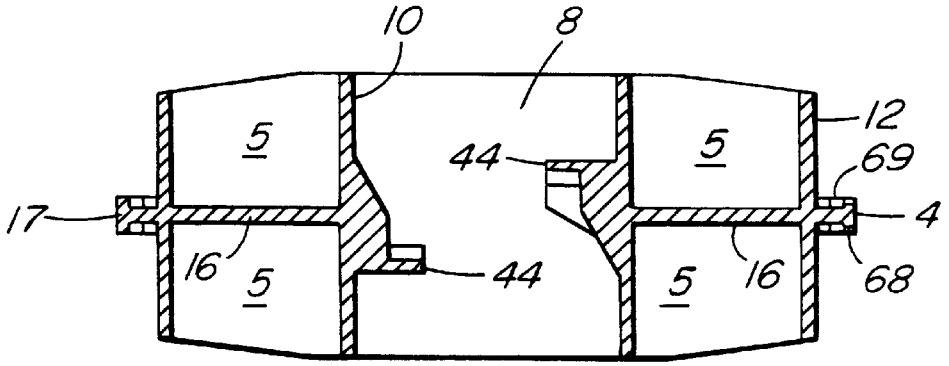
FIG. 10 is a section view through the body taken along line 10—10 of FIG. 9.

Referring to FIGS. 9 and 10, a pair of surfaces 44 are preferably formed in cavity 8, each surface being oriented and positioned to retain a key 40 inserted from an opposite side of body 4 in order that a cover 20 can be mounted over the compartments on each side of the body.

The end of key post 42 is formed with a cavity engaging member to engage with surface 44. Referring back to FIG. 3, the cavity engaging member of key 40 comprises a slot 46 cut into the cylindrical portion of post 42 that intersects flat surface 45 to define a lower lip 47. Key 40 is insertable into cavity 8 of body 4 through central opening 22 in cover 20 to position slot 46 adjacent surface 44. Key 40 is then rotated by the user to move lip 47 into engagement below surface 44 to lock the body and the key together. Key 40 includes a circular bearing flange 50 at the end of post 42 opposite to slot 46 which is adapted to engage with a shoulder 55 formed about opening 22 in cover 20. Cover shoulder 55 is engaged below bearing flange 50 when key 40 is retained in cavity 8 to allow for rotation of cover 20 over body 4 about axis 30. An upstanding ridge 56 is formed atop flange 50 of key 40 to allow a user to easily rotate key 40 when installing or removing the key.

An important feature of the dispenser of the present invention is an automatically engageable lock to prevent further movement of cover 20 with respect to body 4 each time opening 28 is aligned with a compartment 5. The lock requires disengagement by a user whenever cover opening 28 is to be moved for alignment with another compartment. This arrangement ensures that the cover cannot be moved by a child to gain unauthorized access to a full dispenser compartment.

Figure 4:
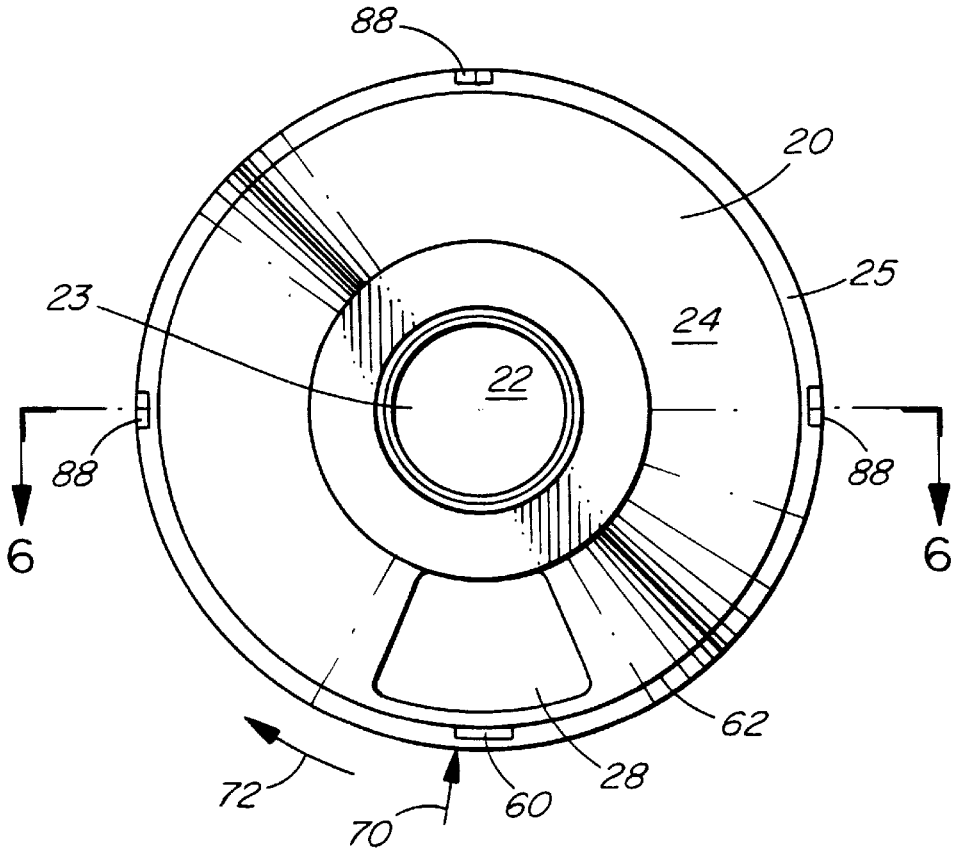
FIG. 4 is a bottom view of a cover used with the dispenser.

As best shown in FIG. 4, which shows the lower side of cover 20, the lock comprises a protruding tab 60 formed on the inside of the lower edge 62 of outer wall 25 of cover 20, and a plurality of slots 64 formed in body 4. Tab 60 is preferably positioned directly below cover opening 28. Slots 64 are preferably formed adjacent each of the compartments 5.

Referring to FIGS. 9 and 10, body 4 includes a raised peripheral wall 68 formed on flange 17 that is formed with slots 64 on the inside edge 69 of the wall. When cover 20 is installed atop body 4, lower edge 62 of the cover engages against the top of wall 68 and depending tab 60 is positioned adjacent inside edge 69 of wall 68 to align tab 60 and the slots 64 for inter-engagement.

Cover 20 is preferably formed from resilient material. Raised peripheral wall 69 of body 4 and cover 20 are dimensioned such that tab 60 is biased radially inwardly when in contact with the inside edge 69 of the raised peripheral wall. In particular, key 40 tends to exert a downward pressure on cap 20 which causes walls 25 to flex outwardly over annular body wall 12. In addition, as previously mentioned walls 25 are angled outwardly at approximately 7½ degrees from the vertical. Therefore, tab 60 tends to move outwardly to engage in one of the plurality of slots 64 whenever the tab is aligned with one of the slots to lock the cover and the body together. This lock is disengageable by simultaneously applying an inward force, indicated by arrow 70 in FIG. 4, to remove tab 60 from slot 64 and rotating the cover as indicated by arrow 72 with respect to the body. After initially disengaging tab 60 from one of the slots 64, tab 60 will tend to ride against the inside edge 69 of wall 68 as the cover is rotated until tab 60 aligns with and engages in the next slot 64. These simultaneous inward and rotary forces to disengage tab 60 from slot 64 are difficult for children to perform and therefore prevent children from disengaging the lock and moving the cover.

Figure 5:
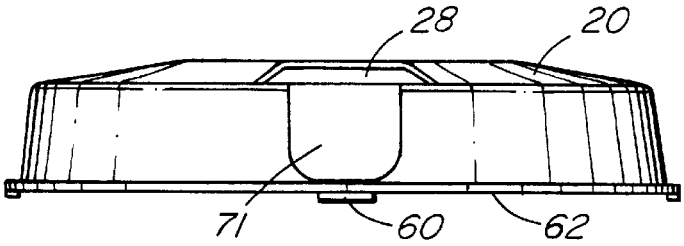
FIG. 5 is a side elevation view of the cover of FIG. 4.
Figure 5A:
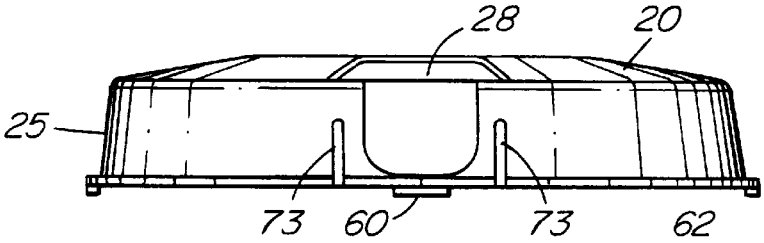
FIG. 5*a* is a side elevation view of an alternative cover formed with slots in the side wall of the cover.

Preferably, as shown in FIG. 5, cover 20 includes a region 71 adapted to be easily deformable inwardly by the user with tab 60 formed on the lower edge of the region. Region 71 is preferably marked by a friction surface of raised ridges or the like to allow the user to clearly identify the region and to prevent slippage when the region is pressed inwardly. In an alternative embodiment, shown in FIG. 5*a,* region 71 also includes a pair of spaced slots 73 extending upwardly from the lower edge of the cover to render the region susceptible to inward displacement on application of pressure by a user.

When using the dispenser of the present invention, it is necessary to periodically refill the compartments 5. This is done most efficiently by removing cover 20 from body 4 to expose all the compartments at once. Unfortunately, easy removal of cover 20 is a weakness when considering the childproofness of the dispenser. The automatic locking system to prevent movement of cover 20 to gain access to an adjacent compartment can be bypassed by removing cover 20 to gain access to all the compartments. This potential problem is overcome by incorporating a locking system to retain key 40 in central cavity 8 of body 4 to effectively lock cover 20 on body 4.

Figure 7:
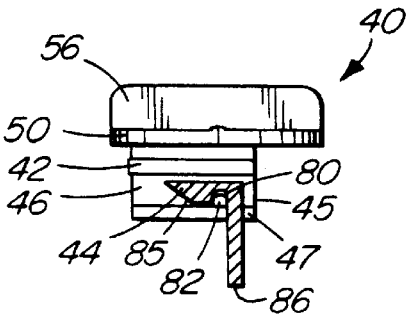
FIG. 7 is a detail view of a key used to connect the cover to the body in the locked position.
Figure 8:
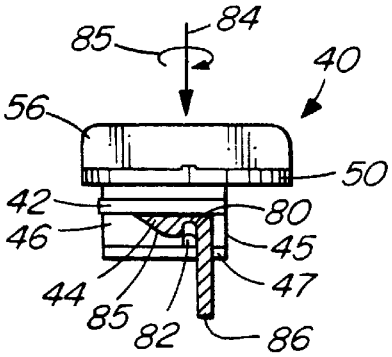
FIG. 8 is a detail view of the key showing the manner in which the key is released from the locked position.

FIGS. 7 and 8 illustrate the details of the locking system. FIGS. 7 and 8 are detail views of key 40 and the inwardly extending surface 44 of body 4. The locking system comprises a channel 80 formed in the lower surface of the inwardly extending surface 44. A corresponding projection 82 is formed on lip 47 of key 40 adapted to engage in channel 80. Key 40 is normally urged outwardly from cavity 8 by resilient cover 20 engaging beneath bearing flange 50. This biases key 40 to a locked position in which projection 82 is retained in channel 80 as illustrated in FIG. 7. In order to move key 40 out of this locked position, simultaneous forces must be applied to the key to urge projection 82 out of channel 80 and rotate lip 47 from its position below inwardly extending surface 44. The necessary forces are illustrated by arrows 84 and 85 in FIG. 8 which shows key 40 being depressed to move projection 82 out of channel 80 and then rotated to remove lip 47 from below surface 44. Preferably, surface 44 is provided with a sloped entrance 85 to channel 80 to guide projection 82 into channel 80. A stop surface 86 is also provided to prevent projection 82 from being rotated past channel 80.

Figure 1:
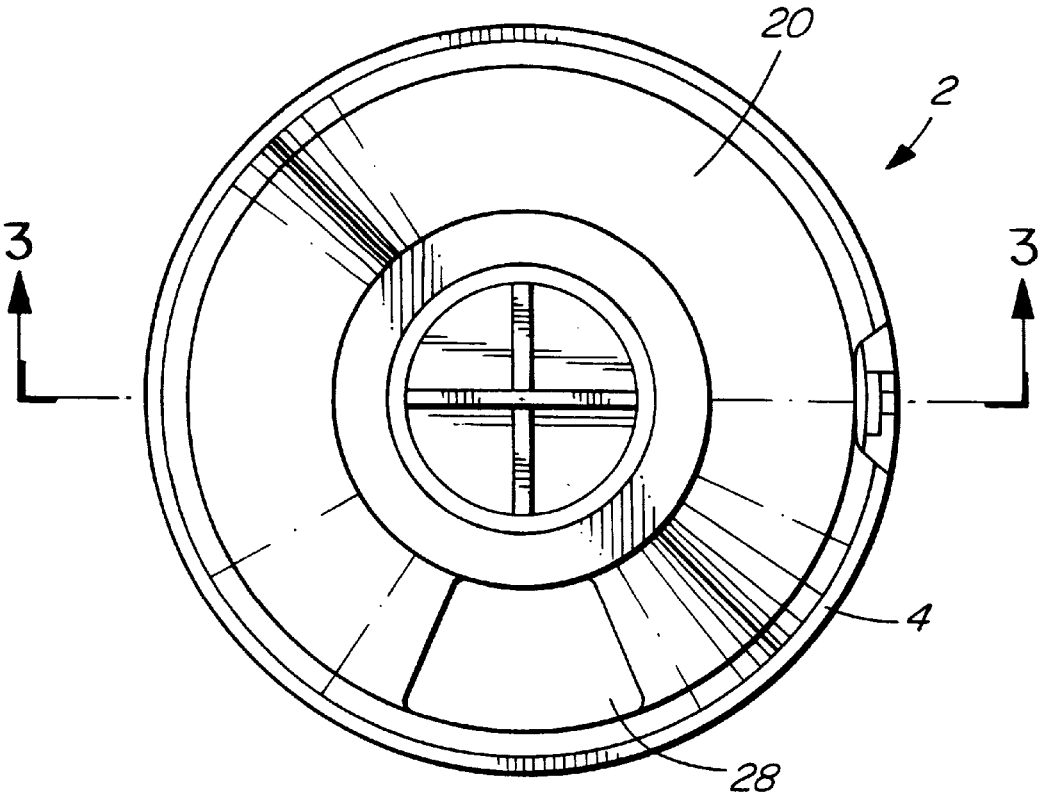
FIG. 1 is a top plan view of a dispenser according to a preferred embodiment.
Figure 2:
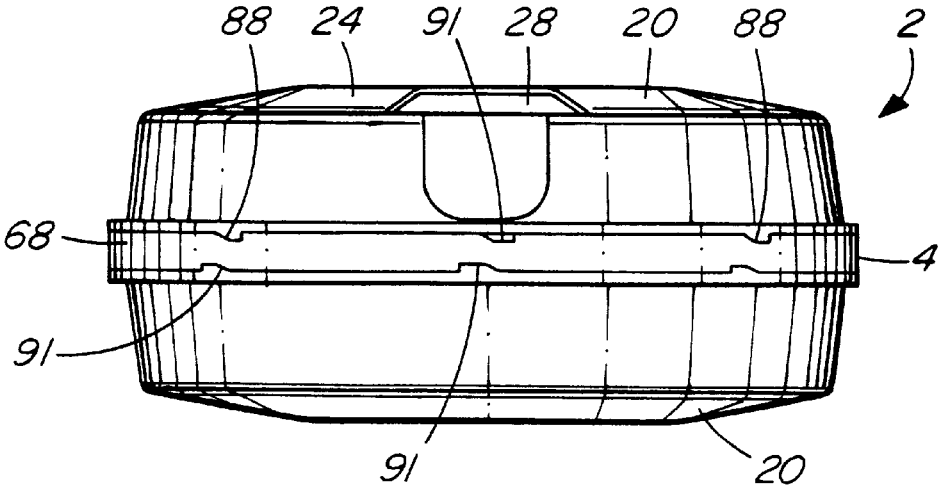
FIG. 2 is a side elevation view of the dispenser of FIG. 1.
Figure 6:
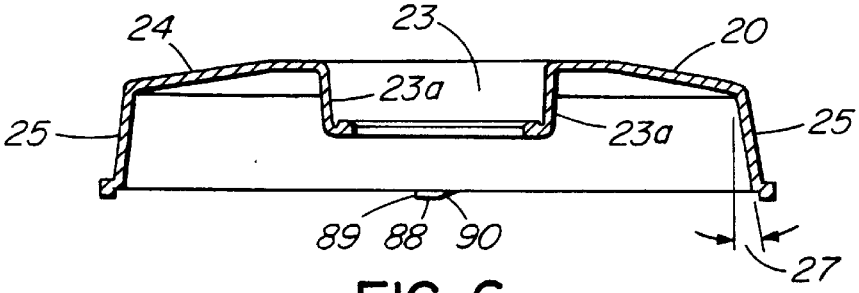
FIG. 6 is a section view through the cover taken along line 6—6 of FIG. 4.

As an additional feature, the dispenser of the present invention includes a guide system to permit movement of the cover with respect to the body in only one direction. This is desirable to ensure that the user always advances the cover in the correct direction to uncover the next available compartment. Referring initially to FIG. 4, the guide system includes a series of tabs 88 formed on the lower outside edge 62 of cover 20 and extending downwardly therefrom. As best shown in FIG. 6, each tab 88 has a substantially vertical edge 89 and an opposite sloped edge 90. There are a plurality of oriented slots 91 formed on the body with each slot having substantially the same shape as tabs 88. Slots 91 are formed in the top edge of peripheral wall 68 as shown in FIG. 2 or FIG. 9. When cover 20 is positioned atop body 4, key 40 urges cover and body 4 together to ensure inter-engagement of tabs 88 in slots 91. Tabs 88 and slots 91 co-operate to permit relative movement of cover 20 with respect to body 4 when tabs 88 are moved in a direction that causes the sloped edges 90 of the tabs to slide over the sloped edges of the slots while movement in the opposite direction is prevented by engagement of the vertical edges 89 of tabs 88 with the vertical edges of the slots 91. During movement of cover 20, tabs 88 ride atop peripheral wall 68 until they are aligned with and engage into the next set of slots 91.

Figure 12:
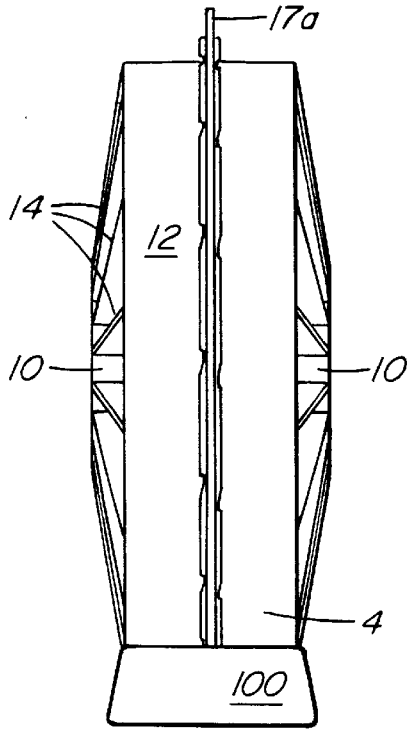
FIG. 12 is an end view of the body of FIG. 11.

FIGS. 11 and 12 illustrate an alternative embodiment of the present in which like features are labelled with identical reference numbers as in the first embodiment. In the embodiment of FIGS. 11 and 12, body 4 is formed with a larger central flange 17 that extends well past outer circular wall 12 to define a surface 17*a* co-planar and co-extensive with floor 16 of compartments 5. As best shown in FIG. 12, generally flat surfaces 100 intersect surface 17*a* and extend a distance on either side of the surface to define feet that allow the dispenser to be supported on end such that disc shaped body 4 is positioned substantially vertically. This position is useful for storage of the dispenser. In addition, surface 17*a* can be formed with openings 101 to allow for attachment of a carrying handle or the like.

Although the present invention has been described in some detail by way of example for purposes of clarity and understanding, it will be apparent that certain changes and modifications may be practised within the scope of the appended claims.

I claim:

1. A dispenser for holding articles comprising:

a generally disc shaped body formed with a plurality of compartments on at least one face of the disc, the compartments being arranged in a generally circular configuration with each compartment being a segment of the circle;

at least one cover rotatably mountable to the body to cover the compartments, the cover including an opening therethrough alignable with each of the compartments by rotation of the cover with respect to the body to permit access to one of the compartments at a time; and an automatically engageable lock to prevent movement of the cover with respect to the body each time the cover opening is aligned with a compartment, the lock requiring disengagement by a user when the cover opening is to be moved for alignment with another compartment.

2. A dispenser as claimed in claim 1 in which the lock comprises:

a protruding tab formed on one of the cover and the body; and a plurality of slots formed on the other of the cover and the body, the tab being biased to engage in one of the slots whenever the tab and one of the slots are aligned to prevent further movement of the cover with respect to the body, the lock being disengageable by simultaneously applying a force to remove the tab from the slot and rotating the cover with respect to the body.

3. A dispenser as claimed in claim 2 in which the tab is formed on the cover and the slots are formed on the body.

4. A dispenser as claimed in claim 3 in which the cover is circular and includes a lower edge with the tab protruding downwardly therefrom, and the body includes a raised peripheral wall with slots formed in the inside edge thereof, the lower edge of the cover engaging against the raised peripheral wall to position the tab and the slots for inter-engagement.

5. A dispenser as claimed in claim 4 in which the cover is formed from resilient material and the raised peripheral wall of the body is dimensioned such that the tab is biased radially inwardly when in contact with the inside edge of the raised peripheral wall and tends to move outwardly to engage in one of the plurality of slots whenever the tab is aligned with one of the slots.

6. A dispenser as claimed in claim 4 in which the tab is formed on the cover to be aligned with the cover opening.

7. A dispenser as claimed in claim 4 in which the cover includes a region adapted to be easily deformable by a user and the tab is formed in said region.

8. A dispenser as claimed in claim 7 in which the region is defined by a pair of spaced slots formed in the lower edge of the cover to render the region susceptible to displacement on application of pressure by a user.

9. A dispenser as claimed in claim 1 including a guide system to permit movement of the cover with respect to the body in only one direction.

10. A dispenser as claimed in claim 9 in which the guide system comprises:

at least one tab formed on one of the cover and the body, the tab having a substantially vertical edge and an opposite sloped edge; and a plurality of oriented slots formed on the other of the cover and the body with each slot having substantially the same shape as the at least one tab to receive the tab, the at least one tab and the plurality of slots co-operating to permit relative movement of the cover with respect to the body when the tab is moved in a direction that causes the sloped edge of the tab to slid over the sloped edge of the slots while movement in the opposite direction is prevented by engagement of the vertical edge of the tab with the vertical edge of one of the slots.

11. A dispenser as claimed in claim 10 in which the at least one tab is formed on the cover and the slots are formed on the body, and the cover and body are biased toward each other to urge the tab into the slots.

12. A dispenser as claimed in claim 11 in which the cover is circular and includes a lower edge with the at least one tab protruding downwardly therefrom, and the body includes a wall having a top edge with the slots formed in the top edge, the lower edge of the cover engaging against the top edge of the wall to position the tab and the slots for inter-engagement.

13. A dispenser as claimed in claim 1 including a key to removably secure the at least one cover to the body for rotatable movement.

14. A dispenser as claimed in claim 13 in which the body includes a central cavity extending therethrough, the cover includes a central opening with an inwardly extending shoulder, and the key comprises an elongate post having a longitudinal axis, a cavity engaging member at one end of the post and a bearing flange at the other end of the post, the key being insertable through the opening of the cover and into the central cavity for retention of the cavity engaging member in the central cavity, the cover shoulder being engageable beneath the bearing flange to retain the cover on the body.

15. A dispenser as claimed in claim 14 in which the central cavity includes an inwardly extending surface beneath which the cavity engaging member of the key is engageable to retain the key in the central cavity.

16. A dispenser as claimed in claim 15 including a locking system to retain the key in the central cavity.

17. A dispenser as claimed in claim 16 in which the locking system comprises:

a channel formed in the lower surface of the inwardly extending surface;

a projection formed on the cavity engaging surface of the key adapted to engage in the channel, the key being biased to a default position in which the projection is retained in the channel until simultaneous forces are applied to the key to urge the projection out of the channel and rotate the cavity engaging surface from beneath the inwardly extending surface.

18. A dispenser as claimed in claim 17 in which the key is biased into the default position by the cover.

19. A dispenser as claimed in claim 1 in which the compartments are marked by indicia.

20. A dispenser as claimed in claim 19 in which the indicia are numbers to indicate days of the month.

21. A dispenser as claimed in claim 19 in which the indicia are abbreviations for the days of the week.

22. A dispenser as claimed in claim 1 in which the cover is translucent or transparent to allow viewing into the covered compartments.

23. A dispenser as claimed in claim 1 in which the compartments are formed on both faces of the disc of the body.

24. A dispenser as claimed in claim 1 including feet extending from the generally disc shaped body to allow the dispenser to stand on edge such that the generally disc shaped body is positioned substantially vertically.

* * * * *